US010760408B2

(12) United States Patent
Adetola et al.

(10) Patent No.: US 10,760,408 B2
(45) Date of Patent: Sep. 1, 2020

(54) METHODS AND SYSTEMS FOR DETECTING RELATIVE POSITIONS OF DOWNHOLE ELEMENTS IN DOWNHOLE OPERATIONS

(71) Applicants: Eli William Adetola, Laatzen (DE); Markus Hempel, Hannover (DE); Thorsten Regener, Wienhausen (DE); Matthias Wauer, Winsen (DE)

(72) Inventors: Eli William Adetola, Laatzen (DE); Markus Hempel, Hannover (DE); Thorsten Regener, Wienhausen (DE); Matthias Wauer, Winsen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 210 days.

(21) Appl. No.: 15/807,689

(22) Filed: Nov. 9, 2017

(65) Prior Publication Data

US 2019/0136685 A1 May 9, 2019

(51) Int. Cl.
*E21B 47/09* (2012.01)
*E21B 33/12* (2006.01)
(Continued)

(52) U.S. Cl.
CPC ..... *E21B 47/0905* (2013.01); *E21B 47/09* (2013.01); *E21B 10/32* (2013.01);
(Continued)

(58) Field of Classification Search
CPC ..... E21B 10/32; E21B 17/1014; E21B 23/01; E21B 29/005; E21B 33/12; E21B 47/0905; E21B 47/122; E21B 47/18
See application file for complete search history.

(56) References Cited

U.S. PATENT DOCUMENTS 5,439,064 A 8/1995 Patton
7,426,967 B2 9/2008 Sugiura
(Continued)

FOREIGN PATENT DOCUMENTS

WO 2010143139 A2 12/2010
WO 2015101520 A1 1/2015
(Continued)

OTHER PUBLICATIONS

Burgess, et al. "Advances in MWD Technology Improve Real Time Data", Oil and Gas Journal 90.7, Feb. 17, 1992: 51; 12 pages.
(Continued)

*Primary Examiner* — Caroline N Butcher
(74) *Attorney, Agent, or Firm* — Cantor Colburn LLP

(57) ABSTRACT

Methods and systems to initiate downhole operations in a borehole include deploying a first structure at least partially in the borehole, moving a second structure at least partially along the first structure, wherein at least one of the first structure and the second structure is equipped with a sensor and the other of the first and second structure is equipped with a marker detectable by the sensor, detecting a critical event that is related to an interaction of the sensor and the marker, measuring a time-since-critical event, determining a time delay based on the time-since-critical event, transmitting, with a telemetry system, data from the earth's subsurface to the earth's surface indicating that the critical event has been detected, and initiating a downhole operation by using the determined time delay.

20 Claims, 5 Drawing Sheets

(51) Int. Cl.

| | |
|---|---|
| *E21B 29/00* | (2006.01) |
| *E21B 47/12* | (2012.01) |
| *E21B 10/32* | (2006.01) |
| *E21B 17/10* | (2006.01) |
| *E21B 47/18* | (2012.01) |
| *E21B 23/01* | (2006.01) |

(52) U.S. Cl.

CPC ..... *E21B 17/1014* (2013.01); *E21B 23/01* (2013.01); *E21B 29/005* (2013.01); *E21B 33/12* (2013.01); *E21B 47/122* (2013.01); *E21B 47/18* (2013.01)

(56) References Cited

U.S. PATENT DOCUMENTS

| | | | | |
|---|---|---|---|---|
| 8,151,902 | B2 | 4/2012 | Lynde et al. | |
| 8,172,007 | B2 | 5/2012 | Dolman et al. | |
| 8,525,690 | B2 | 9/2013 | Puro et al. | |
| 9,004,195 | B2 | 4/2015 | Regener et al. | |
| 2009/0120637 | A1 | 5/2009 | Kirkwood et al. | |
| 2014/0008125 | A1 | 1/2014 | Hay | |
| 2014/0054036 | A1 * | 2/2014 | Regener | E21B 33/14 166/285 |
| 2014/0338896 | A1 | 11/2014 | McGarian et al. | |
| 2015/0060141 | A1 | 3/2015 | Leuenberger et al. | |
| 2015/0247402 | A1 | 9/2015 | Rogozinski et al. | |
| 2016/0047206 | A1 | 2/2016 | Vempati et al. | |
| 2016/0060960 | A1 | 3/2016 | Parkin et al. | |

FOREIGN PATENT DOCUMENTS

| | | | | |
|---|---|---|---|---|
| WO | 2016054698 | A1 | 4/2016 | |
| WO | 2016100687 | A1 | 6/2016 | |
| WO | 2016186623 | A1 | 11/2016 | |
| WO | WO-2016175777 | A1 * | 11/2016 | E21B 47/09 |
| WO | WO-2017123209 | A1 * | 7/2017 | E21B 47/044 |

OTHER PUBLICATIONS

Erlandsen, et al. "World's first multiple fiber-optic intelligent well", World Oil 224.3 (Mar. 2003):29(4); 6 pages.

Wu, et al. "A Time-Driven Transmission Method for Well Logging Networks", Petroleum Science 6.3 (2009): 239-245; 7 pages.

International Search Report, International Application No. PCT/US2018/060045, dated Feb. 1, 2019, Korean Intellectual Property Office; International Search Report 3 pages.

International Written Opinion, International Application No. PCT/US2018/060045, dated Feb. 1, 2019, Korean Intellectual Property Office; International Written Opinion 7 pages.

* cited by examiner

METHODS AND SYSTEMS FOR DETECTING RELATIVE POSITIONS OF DOWNHOLE ELEMENTS IN DOWNHOLE OPERATIONS

BACKGROUND

1. Field of the Invention

The present invention generally relates to downhole operations and determining relative positions of components used in downhole operations.

2. Description of the Related Art

Boreholes are drilled deep into the earth for many applications such as carbon dioxide sequestration, geothermal production, and hydrocarbon exploration and production. In all of the applications, the boreholes are drilled such that they pass through or allow access to a material (e.g., heat, a gas, or fluid) contained in a formation located below the earth's surface. Different types of tools and instruments may be disposed in the boreholes to perform various tasks and measurements.

When performing downhole operations, it is important to know what is happening and where so that appropriate actions can be taken. Different solutions have been proposed to measure relative positions between two different elements downhole. Information relating to downhole measurements and detections is transmitted to the surface for processing and decision making. For example, wired pipe can be used to transmit data via special drill pipes like a "long cable." Another transmission technique is mud pulse telemetry. In this case, bore fluid is used as a communication channel to transmit information encoded into pulses that are sent through the bore fluid. Other telemetry techniques comprise acoustic telemetry or electromagnetic telemetry.

The disclosure herein provides improvements to measuring relative positions of downhole elements and providing a simple communication technique related thereto.

SUMMARY

Disclosed herein are methods and systems to initiate downhole operations in a borehole include deploying a first structure at least partially in the borehole, moving a second structure at least partially along the first structure, wherein at least one of the first structure and the second structure is equipped with a sensor and the other of the first and second structure is equipped with a marker detectable by the sensor, detecting a critical event that is related to an interaction of the sensor and the marker, measuring a time-since-critical event, determining a time delay based on the time-since-critical event, transmitting, with a telemetry system, data from the earth's subsurface to the earth's surface indicating that the critical event has been detected, and initiating a downhole operation by using the determined time delay.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION

Figure 1:
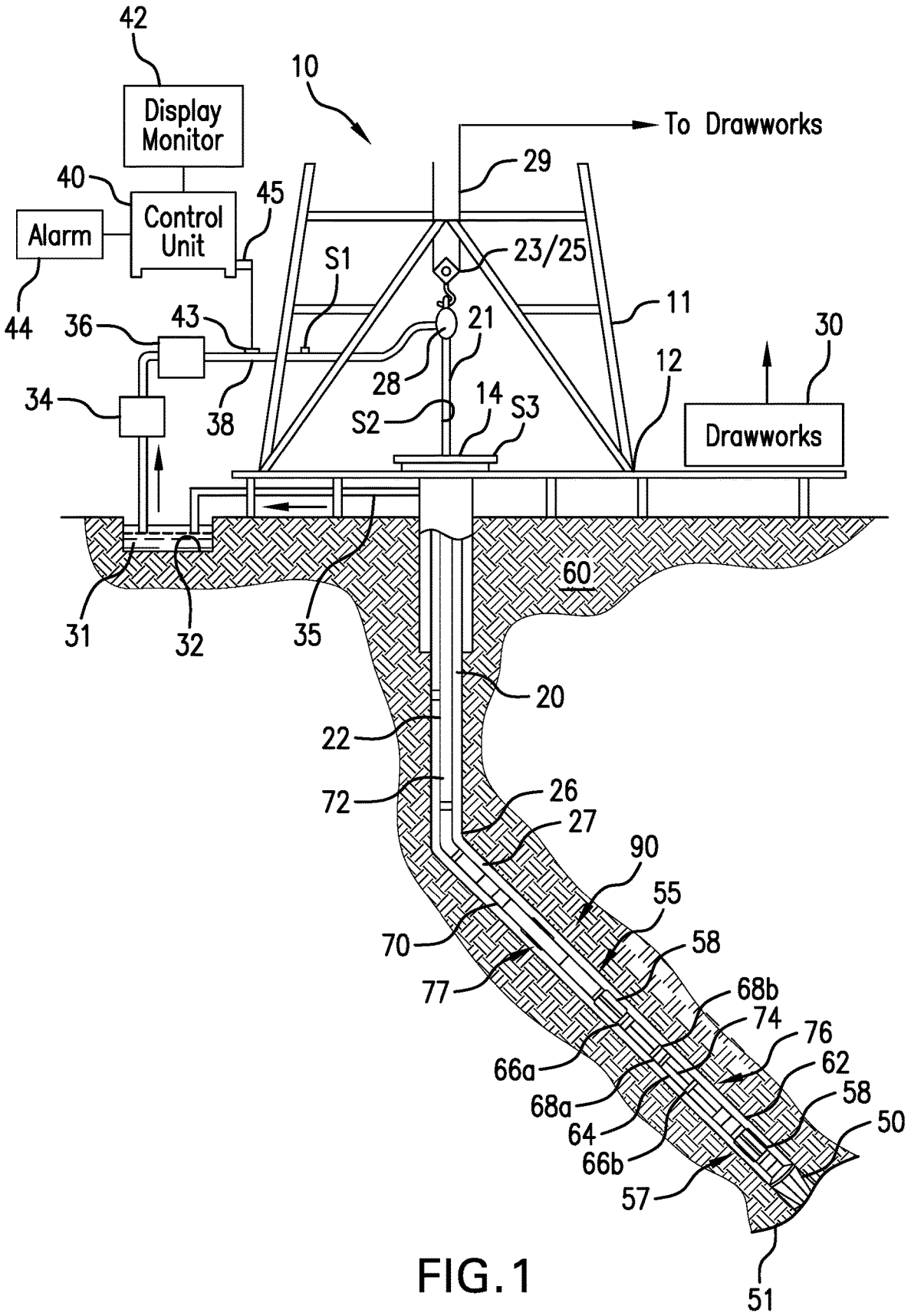
FIG. 1 is an example of a system for performing downhole operations that can employ embodiments of the present disclosure.

FIG. 1 shows a schematic diagram of a system for performing downhole operations. As shown, the system is a drilling system 10 that includes a drill string 20 having a drilling assembly 90, also referred to as a bottomhole assembly (BHA), conveyed in a borehole or wellbore 26 penetrating an earth formation 60. The drilling system 10 includes a conventional derrick 11 erected on a floor 12 that supports a rotary table 14 that is rotated by a prime mover, such as an electric motor (not shown), at a desired rotational speed. The drill string 20 includes a drilling tubular 22, such as a drill pipe, extending downward from the rotary table 14 into the borehole 26. A disintegrating tool 50, such as a drill bit attached to the end of the drilling assembly 90, disintegrates the geological formations when it is rotated to drill the borehole 26. The drill string 20 is coupled to a drawworks 30 via a kelly joint 21, swivel 28, traveling block 25, and line 29 through a pulley 23. During the drilling operations, the drawworks 30 is operated to control the weight on bit, which affects the rate of penetration. The operation of the drawworks 30 is well known in the art and is thus not described in detail herein.

During drilling operations a suitable drilling fluid 31 (also referred to as the "mud") from a source or mud pit 32 is circulated under pressure through the drill string 20 by a mud pump 34. The drilling fluid 31 passes into the drill string 20 via a desurger 36, fluid line 38 and the kelly joint 21. Fluid line 38 may also be referred to as a mud supply line. The drilling fluid 31 is discharged at the borehole bottom 51 through an opening in the disintegrating tool 50. The drilling fluid 31 circulates uphole through the annular space 27 between the drill string 20 and the borehole 26 and returns to the mud pit 32 via a return line 35. A sensor 51 in the line 38 provides information about the fluid flow rate. A surface torque sensor S2 and a sensor S3 associated with the drill string 20 respectively provide information about the torque and the rotational speed of the drill string. Additionally, one or more sensors (not shown) associated with line 29 are used to provide the hook load of the drill string 20 and about other desired parameters relating to the drilling of the wellbore 26. The system may further include one or more downhole sensors 70 located on the drill string 20 and/or the drilling assembly 90.

In some applications the disintegrating tool 50 is rotated by rotating the drill pipe 22. However, in other applications, a drilling motor 55 (such as a mud motor) disposed in the drilling assembly 90 is used to rotate the disintegrating tool 50 and/or to superimpose or supplement the rotation of the drill string 20. In either case, the rate of penetration (ROP) of the disintegrating tool 50 into the formation 60 for a given formation and a drilling assembly largely depends upon the weight on bit and the rotational speed of the disintegrating tool 50. In one aspect of the embodiment of FIG. 1, the drilling motor 55 is coupled to the disintegrating tool 50 via a drive shaft (not shown) disposed in a bearing assembly 57. If a mud motor is employed as the drilling motor 55, the mud motor rotates the disintegrating tool 50 when the drilling fluid 31 passes through the drilling motor 55 under pressure. The bearing assembly 57 supports the radial and axial forces of the disintegrating tool 50, the downthrust of the drilling motor and the reactive upward loading from the applied weight on bit. Stabilizers 58 coupled to the bearing assembly 57 and at other suitable locations on the drill string 20 act as centralizers, for example for the lowermost portion of the drilling motor assembly and other such suitable locations.

A surface control unit 40 receives signals from the downhole sensors 70 and devices via a sensor 43 placed in the fluid line 38 as well as from sensors S1, S2, S3, hook load sensors, sensors to determine the height of the traveling block (block height sensors), and any other sensors used in the system and processes such signals according to programmed instructions provided to the surface control unit 40. For example, a surface depth tracking system may be used that utilizes the block height measurement to determine a length of the borehole (also referred to as measured depth of the borehole) or the distance along the borehole from a reference point at the surface to a predefined location on the drill string 20, such as the drill bit 50 or any other suitable location on the drill string 20 (also referred to as measured depth of that location, e.g. measured depth of the drill bit 50). Determination of measured depth at a specific time may be accomplished by adding the measured block height to the sum of the lengths of all equipment that is already within the wellbore at the time of the block-height measurement, such as, but not limited to drill pipes 22, drilling assembly 90, and disintegrating tool 50. Depth correction algorithms may be applied to the measured depth to achieve more accurate depth information. Depth correction algorithms, for example, may account for length variations due to pipe stretch or compression due to temperature, weight-on-bit, wellbore curvature and direction. By monitoring or repeatedly measuring block height, as well as lengths of equipment that is added to the drill string 20 while drilling deeper into the formation over time, pairs of time and depth information are created that allow estimation of the depth of the borehole 26 or any location on the drill string 20 at any given time during a monitoring period. Interpolation schemes may be used when depth information is required at a time between actual measurements. Such devices and techniques for monitoring depth information by a surface depth tracking system are known in the art and therefore are not described in detail herein.

The surface control unit 40 displays desired drilling parameters and other information on a display/monitor 42 for use by an operator at the rig site to control the drilling operations. The surface control unit 40 contains a computer that may comprise memory for storing data, computer programs, models and algorithms accessible to a processor in the computer, a recorder, such as tape unit, memory unit, etc. for recording data and other peripherals. The surface control unit 40 also may include simulation models for use by the computer to process data according to programmed instructions. The control unit responds to user commands entered through a suitable device, such as a keyboard. The control unit 40 can output certain information through an output device, such as s display, a printer, an acoustic output, etc., as will be appreciated by those of skill in the art. The control unit 40 is adapted to activate alarms 44 when certain unsafe or undesirable operating conditions occur.

The drilling assembly 90 may also contain other sensors and devices or tools for providing a variety of measurements relating to the formation 60 surrounding the borehole 26 and for drilling the wellbore 26 along a desired path. Such devices may include a device for measuring formation properties, such as the formation resistivity or the formation gamma ray intensity around the borehole 26, near and/or in front of the disintegrating device 50 and devices for determining the inclination, azimuth and/or position of the drill string. A logging-while-drilling (LWD) device for measuring formation properties, such as a formation resistivity tool 64 or a gamma ray device 76 for measuring the formation gamma ray intensity, made according an embodiment described herein may be coupled to the drill string 20 including the drilling assembly 90 at any suitable location. For example, coupling can be above a lower kick-off subassembly 62 for estimating or determining the resistivity of the formation 60 around the drill string 20 including the drilling assembly 90. Another location may be near or in front of the disintegrating tool 50, or at other suitable locations. A directional survey tool 74 that may comprise means to determine the direction of the drilling assembly 90 with respect to a reference direction (e.g., magnetic north, vertical up or down direction, etc.), such as a magnetometer, gravimeter/accelerometer, gyroscope, etc. may be suitably placed for determining the direction of the drilling assembly, such as the inclination, the azimuth, and/or the toolface of the drilling assembly. Any suitable directional survey tool may be utilized. For example, the directional survey tool 74 may utilize a gravimeter, a magnetometer, or a gyroscopic device to determine the drill string direction (e.g., inclination, azimuth, and/or toolface). Such devices are known in the art and therefore are not described in detail herein.

Direction of the drilling assembly may be monitored or repeatedly determined to allow for, in conjunction with depth measurements as described above, the determination of a wellbore trajectory in a three-dimensional space. In the above-described example configuration, the drilling motor 55 transfers power to the disintegrating tool 50 via a shaft (not shown), such as a hollow shaft, that also enables the drilling fluid 31 to pass from the drilling motor 55 to the disintegrating tool 50. In alternative embodiments, one or more of the parts described above may appear in a different order, or may be omitted from the equipment described above.

Still referring to FIG. 1, other LWD devices (generally denoted herein by numeral 77), such as devices for measuring rock properties or fluid properties, such as, but not limited to, porosity, permeability, density, salt saturation, viscosity, permittivity, sound speed, etc. may be placed at suitable locations in the drilling assembly 90 for providing information useful for evaluating the subsurface formations 60 or fluids along borehole 26. Such devices may include, but are not limited to, acoustic tools, nuclear tools, nuclear magnetic resonance tools, permittivity tools, and formation testing and sampling tools.

The above-noted devices may store data to a memory downhole and/or transmit data to a downhole telemetry system 72, which in turn transmits the received data uphole to the surface control unit 40. The downhole telemetry system 72 may also receive signals and data from the surface control unit 40 and may transmit such received signals and data to the appropriate downhole devices. In one aspect, a mud pulse telemetry system may be used to communicate data between the downhole sensors 70 and devices and the surface equipment during drilling operations. A sensor 43 placed in the fluid line 38 may detect the mud pressure variations, such as mud pulses responsive to the data transmitted by the downhole telemetry system 72. Sensor 43 may generate signals (e.g., electrical signals) in response to the mud pressure variations and may transmit such signals via a conductor 45 or wirelessly to the surface control unit 40. In other aspects, any other suitable telemetry system may be used for one-way or two-way data communication between the surface and the drilling assembly 90, including but not limited to, a wireless telemetry system, such as an acoustic telemetry system, an electro-magnetic telemetry system, a wired pipe, or any combination thereof. The data communication system may utilize repeaters in the drill string or the wellbore. One or more wired pipes may be made up by joining drill pipe sections, wherein each pipe section includes a data communication link that runs along the pipe. The data connection between the pipe sections may be made by any suitable method, including but not limited to, electrical or optical line connections, including optical, induction, capacitive or resonant coupling methods. A data communication link may also be run along a side of the drill string 20, for example, if coiled tubing is employed.

The drilling system described thus far relates to those drilling systems that utilize a drill pipe to convey the drilling assembly 90 into the borehole 26, wherein the weight on bit is controlled from the surface, typically by controlling the operation of the drawworks. However, a large number of the current drilling systems, especially for drilling highly deviated and horizontal wellbores, utilize coiled-tubing for conveying the drilling assembly downhole. In such application a thruster is sometimes deployed in the drill string to provide the desired force on the disintegrating tool 50. Also, when coiled-tubing is utilized, the tubing is not rotated by a rotary table but instead it is injected into the wellbore by a suitable injector while a downhole motor, such as drilling motor 55, rotates the disintegrating tool 50. For offshore drilling, an offshore rig or a vessel is used to support the drilling equipment, including the drill string.

Still referring to FIG. 1, a resistivity tool 64 may be provided that includes, for example, a plurality of antennas including, for example, transmitters 66*a* or 66*b* or and receivers 68*a* or 68*b*. Resistivity can be one formation property that is of interest in making drilling decisions. Those of skill in the art will appreciate that other formation property tools can be employed with or in place of the resistivity tool 64.

Liner drilling or casing drilling can be one configuration or operation used for providing a disintegrating device that becomes more and more attractive in the oil and gas industry as it has several advantages compared to conventional drilling. One example of such configuration is shown and described in commonly owned U.S. Pat. No. 9,004,195, entitled "Apparatus and Method for Drilling a Wellbore, Setting a Liner and Cementing the Wellbore During a Single Trip," which is incorporated herein by reference in its entirety. Importantly, despite a relatively low rate of penetration, the time of getting a liner to target is reduced because the liner is run in-hole while drilling the wellbore simultaneously. This may be beneficial in swelling formations where a contraction of the drilled well can hinder an installation of the liner later on. Furthermore, drilling with liner in depleted and unstable reservoirs minimizes the risk that the pipe or drill string will get stuck due to hole collapse.

Although FIG. 1 is shown and described with respect to a drilling operation, those of skill in the art will appreciate that similar configurations, albeit with different components, can be used for performing different downhole operations. For example, wireline, coiled tubing, and/or other configurations can be used as known in the art. Further, production configurations can be employed for extracting and/or injecting materials from/into earth formations. Thus, the present disclosure is not to be limited to drilling operations but can be employed for any appropriate or desired downhole operation(s).

Figure 2:
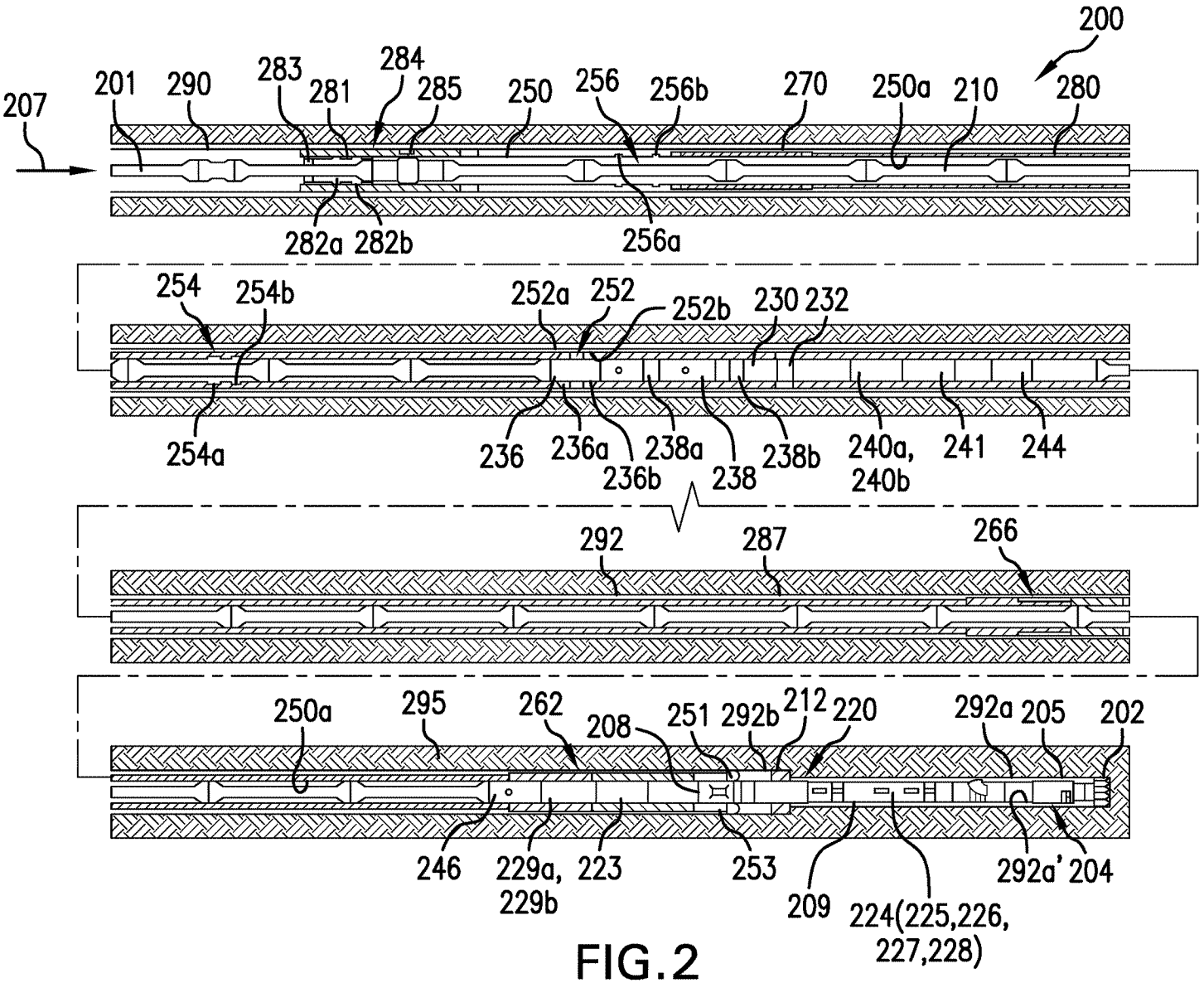
FIG. 2 is a line diagram of an example drill string that includes an inner string and an outer string, wherein the inner string is connected to a first location of the outer string to drill a hole of a first size that can employ embodiments of the present disclosure.

Turning now to FIG. 2, a schematic line diagram of an example system 200 that includes a first structure disposed along a second structure. At least a part of the first or second structure is disposed below the earth's surface. The first or second structure may be operatively connected to the equipment above the earth's surface. In the embodiment of FIG. 2, the first structure is an inner structure 210 disposed at least partially in an outer structure 250, as shown. However, disposing the inner structure 210 at least partially in the outer structure 250 is not to be understood as a limitation. The disclosed apparatus, systems, and methods are the same if applied to a system where a first and second structure are disposed in parallel and not within each other. In the embodiment of FIG. 2, the inner structure 210 is an inner string, including a drilling assembly 220, also known as bottom hole assembly (BHA), as described below. Further, as illustrated, the outer structure 250 is a casing, a liner, or an outer string. In another embodiment, the outer structure may be the formation (e.g., formation 60 shown in FIG. 1). The inner structure 210 includes various tools that are moveable within and relative to the outer structure 250. As described herein, various of the tools of the inner structure 210 can act upon and/or with portions of the outer structure 250 to perform certain downhole operations. Further, various of the tools of the inner structure 210 can extend axially beyond the outer structure 250 to perform other downhole operations, such as drilling.

In the embodiment of FIG. 2, the inner structure 210 is adapted to pass through the outer structure 250 and connect to the inside 250*a* of the outer structure 250 at a number of spaced apart locations (also referred to herein as the "landings" or "landing locations"). The shown embodiment of the outer structure 250 includes three landings, namely a lower landing 252, a middle landing 254 and an upper landing 256. The inner structure 210 includes a drilling assembly 220 connected to a bottom end of a tubular member 201, such as a string of jointed pipes or a coiled tubing. The drilling assembly 220 includes a first disintegrating device 202 (also referred to herein as a "pilot bit") at its bottom end for drilling a borehole of a first size 292*a* (also referred to herein as a "pilot hole"). The drilling assembly 220 further includes a steering device 204 that in some embodiments may include a number of force application members 205 configured to extend from the steering device 204 to apply force on a wall 292*a*' of the pilot hole 292*a* drilled by the pilot bit 202 to steer the pilot bit 202 along a selected direction, such as to drill a deviated pilot hole. The drilling assembly 220 may also include a drilling motor 208 (also referred to as a "mud motor") configured to rotate the pilot bit 202 when a fluid 207 under pressure is supplied to the inner structure 210.

In the configuration of FIG. 2, the drilling assembly 220 is also shown to include an under reamer 212 that can be extended from and retracted toward a body of the drilling assembly 220, as desired, to enlarge the pilot hole 292*a* to form a wellbore 292*b*, to at least the size of the outer string. In various embodiments, for example as shown, the drilling assembly 220 includes a number of sensors (collectively designated by numeral 209) for providing signals relating to a number of downhole parameters, including, but not limited to, various properties or characteristics of a formation 295, the fluid 207, and parameters relating to the operation of the system 200. The drilling assembly 220 also includes a control circuit (also referred to as a "controller") 224 that may include circuits 225 to condition the signals from the various sensors 209, a processor 226, such as a microprocessor, a data storage device 227, such as a solid-state memory, and programs 228 accessible to the processor 226 for executing instructions contained in the programs 228. The controller 224 communicates with a surface controller (not shown) via a suitable telemetry device 229*a* that provides one-way or two-way communication between the inner structure 210 and the surface controller. The telemetry unit 229*a* may utilize any suitable data communication technique, including, but not limited to, mud pulse telemetry, acoustic telemetry, electromagnetic telemetry, and wired pipe. A power generation unit 229*b* in the inner structure 210 provides electrical power to the various components in the inner structure 210, including the sensors 209 and other components such as valves, motors, or actuators in the drilling assembly 220. The drilling assembly 220 also may include a second power generation device 223 capable of providing electrical power independent from the presence of the power generated using the drilling fluid 207 (e.g., third power generation device 240*b* described below).

In various embodiments, such as that shown, the inner structure 210 may further include a sealing device 230 (also referred to as a "seal sub") that may include a sealing element 232, such as an expandable and retractable packer, configured to provide a fluid seal between the inner structure 210 and the outer structure 250 when the sealing element 232 is activated to be in an expanded state. Additionally, the inner structure 210 may include a liner drive sub 236 that includes attachment elements 236*a*, 236*b* (e.g., latching elements) that may be removably connected to any of the landing locations in the outer structure 250. The inner structure 210 may further include a hanger activation device or sub 238 having seal members 238*a*, 238*b* configured to activate a rotatable hanger 270 in the outer structure 250. The inner structure 210 may include a third power generation device 240*b*, such as a turbine-driven device, operated by the fluid 207 flowing through the inner structure 210 configured to generate electric power, and a second one-way or two-way telemetry device 240*a* utilizing any suitable communication technique, including, but not limited to, mud pulse, acoustic, electromagnetic and wired pipe telemetry. The inner structure 210 may further include a fourth power generation device 241, independent from the presence of a power generation source using drilling fluid 207, such as batteries. The inner structure 210 may further include pup joints 244, jars (not shown), and a burst sub 246.

Still referring to FIG. 2, the outer structure 250 includes a liner 280 that may house or contain a second disintegrating device 251 (e.g., also referred to herein as a reamer bit) at its lower end thereof. A downhole operation where a liner is involved is generally called a liner operation. The reamer bit 251 is configured to enlarge a leftover portion of hole 292*a* made by the pilot bit 202. In aspects, attaching the inner string at the lower landing 252 enables the inner structure 210 to drill the pilot hole 292*a* and the under reamer 212 to enlarge it to the borehole of size 292 that is at least as large as the outer structure 250. Attaching the inner structure 210 at the middle landing 254 enables the reamer bit 251 to enlarge the section of the hole 292*a* not enlarged by the under reamer 212 (also referred to herein as the "leftover hole" or the "remaining pilot hole"). Attaching the inner structure 210 at the upper landing 256, enables cementing an annulus 287 between the liner 280 and the formation 295 without pulling the inner structure 210 to the surface, i.e., in a single trip of the system 200 downhole. The lower landing 252 may include a female spline 252*a* and a collet grove 252*b* for attaching to the attachment elements 236*a* and 236*b* of the liner drive sub 236. Similarly, the middle landing 254 includes a female spline 254*a* and a collet groove 254*b* and the upper landing 256 includes a female spline 256*a* and a collet groove 256*b*. Any other suitable attaching and/or latching mechanisms for connecting the inner structure 210 to the outer structure 250 may be utilized for the purpose of this disclosure.

The outer structure 250 may further include a flow control device 262, such as a backflow prevention assembly or device, placed on the inside 250*a* of the outer structure 250 proximate to its lower end 253. In FIG. 2, the flow control device 262 is in a deactivated or open position. In such a position, the flow control device 262 allows fluid communication of the region between the formation 295 and the outer structure 250 and the region within the inside 250*a* of the outer structure 250. In some embodiments, the flow control device 262 can be activated (i.e., closed) when the pilot bit 202 is retrieved inside the outer structure 250 to prevent fluid communication from the wellbore 292 to the inside 250*a* of the outer structure 250. The flow control device 262 is deactivated (i.e., opened) when the pilot bit 202 is extended outside the outer structure 250. In one aspect, the force application members 205 or another suitable device may be configured to activate the flow control device 262.

A reverse flow control device 266, such as a reverse flapper or other backflow prevention structure, also may be provided to prevent fluid communication from the inside of the outer structure 250 at locations above the reverse flow control device 266 to locations below the reverse flow control device 266. The outer structure 250 also includes a hanger 270 that may be activated by the hanger activation sub 238 to anchor the outer structure 250 to the host casing 290. The host casing 290 is deployed in the wellbore 292 prior to further drilling out the wellbore 292 with the system 200. In one aspect, the outer structure 250 includes a sealing device 285 to provide a seal between the outer structure 250 and the host casing 290. The outer structure 250 further includes a receptacle 284 at its upper end that may include a protection sleeve 281 having a female spline 282*a* and a collet groove 282*b*. A debris barrier 283 may also be provided to prevent cuttings made by the pilot bit 202, the under reamer 212, and/or the reamer bit 251 from entering the space or annulus between the inner structure 210 and the outer structure 250.

To drill the wellbore 292, the inner structure 210 is placed inside the outer structure 250 and attached to the outer structure 250 at the lower landing 252 by activating the attachment elements 236*a*, 236*b* of the liner drive sub 236 as shown. This liner drive sub 236, when activated, connects the attachment element 236*a* to the female splines 252*a* and the attachment element 236*b* to the collet groove 252*b* in the lower landing 252. In this configuration, the pilot bit 202 and the under reamer 212 extend past the reamer bit 251. In operation, the drilling fluid 207 powers the drilling motor 208 that rotates the pilot bit 202 to cause it to drill the pilot hole 292*a* while the under reamer 212 enlarges the pilot hole 292*a* to the diameter of the wellbore 292*b* at at least the size of the outer string. The pilot bit 202 and the under reamer 212 may also be rotated by rotating the drill system 200, in addition to rotating one or both of them by the drilling motor 208.

In general, there are three different configurations and/or operations that are carried out with the system 200: drilling, reaming and cementing. In drilling a position the drilling assembly 220 at least partially sticks out of the outer structure 250 for enabling the measuring and steering capability (e.g., as shown in FIG. 2). In a reaming position, a reduced portion of the inner structure 210, e.g., only the first disintegrating device 202 (e.g., pilot bit) is outside the outer structure 250 to reduce the risk of stuck pipe or drill string in case of well collapse and the remainder of the drilling assembly 220 is housed within the outer structure 250. In a cementing position the drilling assembly 220 is located inside the outer structure 250 a certain distance from the second disintegrating device (e.g., reamer bit 251) to ensure a proper shoe track.

When performing downhole operations, using systems such as that shown and described above in FIGS. 1-2, it is advantageous to monitor what is occurring downhole. Some such solutions include wired pipe (WP) where monitoring is performed using one or more sensors and/or devices and collected data is transmitted via special drill pipes like a "long cable." Another solution employs communication via mud pulse telemetry, where the bore fluid is used as a communication channel. In such embodiments, pressure pulses are generated down hole (encoded), and a pressure transducer converts the pressure pulses into electrical signals (encoded). Mud pulse telemetry (MPT) is in comparison with wired pipe very slow (e.g., by several orders of magnitude, such as a factor of one thousand). One specific piece of information is location. This is particularly true when a downhole operation is desired to be performed at a very specific point along a wellbore, such as, but not limited to, packer deployment, reaming, underreaming, and/or extending stablizers, reamer blades, latching elements, anchors, hangers, etc.

For liner drilling services, when using a system such as that shown and described with respect to FIG. 2, it may be needed to detect or find different positions at locations up to 6,000 meters or greater away from the surface. Further, it may be desirable to know if the liner has been moving after a setting operation and to correct for inaccuracies in the tally sheet. In accordance with embodiments of the present disclosure, markers are positioned at one or more locations along an outer structure (such as a liner, outer string, casing, etc.) or an inner structure and a sensor is carried on an inner structure (e.g., a drilling assembly, an inner string, a wireline tool, etc.) or an outer structure, respectively, which can detect the position of the marker(s). If mud pulse telemetry communication is employed, a transmission time of 25 seconds or greater can occur (e.g., time from marker detection until the information is displayed at the surface). To account for the delay, a large detection area and/or a slow tripping speed may be employed. The large detection area and/or slow tripping speed can result in a margin of error of between 50 cm-100 cm. It may be advantageous to improve the accuracy of position detection downhole.

In accordance with embodiments of the present disclosure, optimization of position detection is achieved, especially via mud pulse telemetry. Further, embodiments of the present disclosure can eliminate slow tripping speeds to compensate low data rate communication(s) for position detection, which can make position detection difficult and expensive. In accordance with some embodiments of the present disclosure a relatively small detection region (i.e., for detecting a marker) is sufficient (e.g., less than 10 cm, such as 2 cm) and can detect the exact position of the marker (e.g., with a margin of error of about 10 cm or less). Accordingly, a display at the surface can show the exact position of various downhole components based on the known position of a sensor along an inner structure.

Further, in accordance with one embodiment of the present disclosure, it is possible to have an inner or outer structure (with a sensor) pass an outer or inner structure (with a marker), respectively, without flow and thus no mud pulse telemetry communication. However, the system can detect the presence of the marker and thus retain information regarding time of interaction. Then, once circulation begins again, this time information can be used to determine relative positions very precisely. In such an embodiment, in the absence of flow, the system to detect the presence of the marker may use power provided by an energy storage device, such as a battery. As such, tripping or drilling speeds during marker finding procedures are not critical. Accordingly, no additional expensive electrical parts are needed to enable precise position detection, such as high precision clocks (e.g., atomic clocks). Furthermore, in accordance with one embodiment of the present disclosure, it is possible to detect multiple markers during a tripping or drilling operation. Such multiple-detection can enable optimization of any adjustment procedures.

Figure 3:
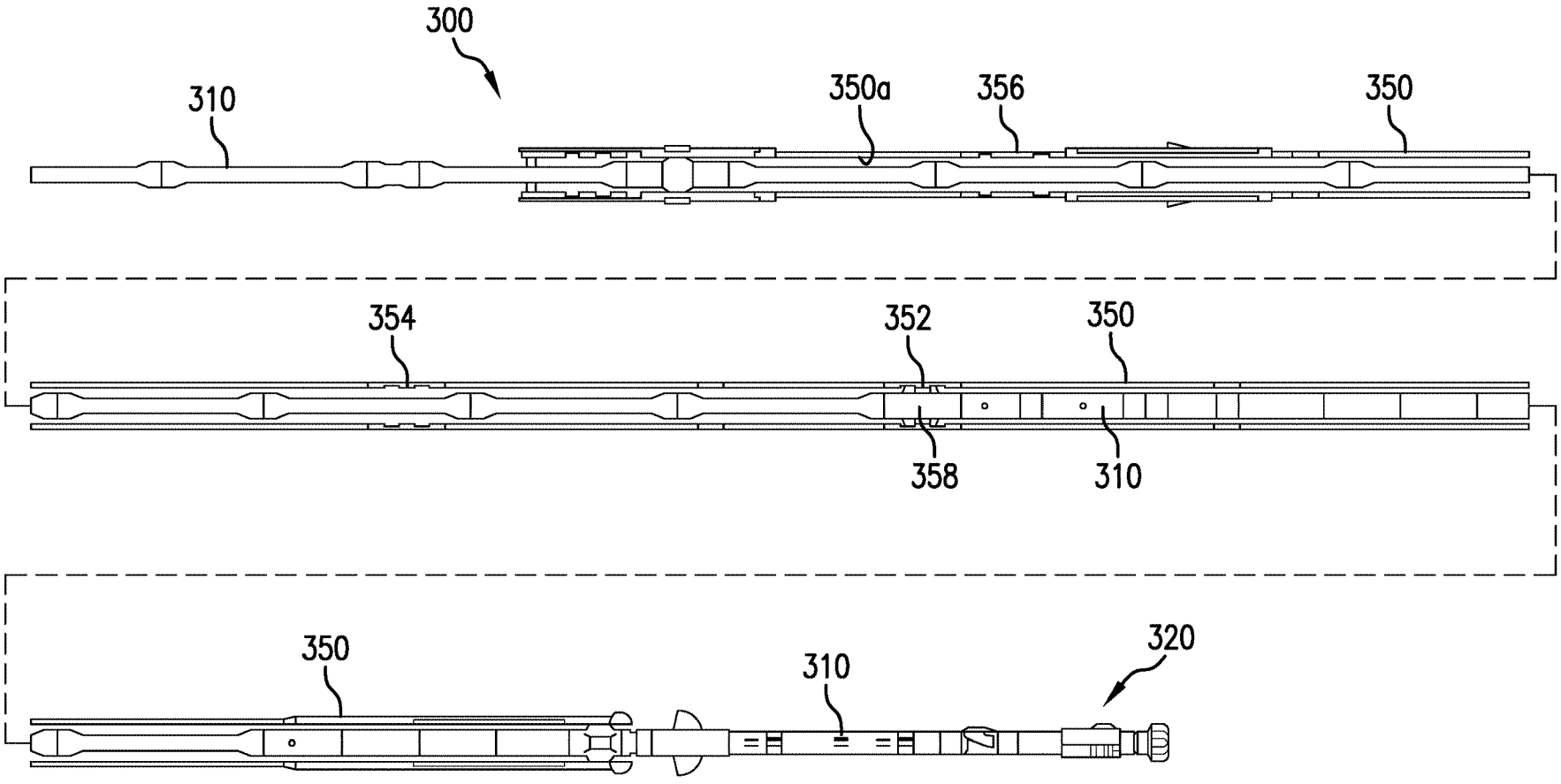
FIG. 3 is a schematic illustration of a downhole system having an inner structure that is moveable relative to an outer structure that can employ embodiments of the present disclosure.

Turning now to FIG. 3, a schematic illustration of a system 300 in accordance with an embodiment of the present disclosure is shown. In this embodiment, similar to that described above, an inner structure 310 is adapted to pass through an outer structure 350 and connect to the inside 350*a* of the outer structure 350 at a number of spaced apart locations (also referred to herein as the "landings" or "landing locations"). The shown embodiment of the outer structure 350 includes three landings, namely a lower landing 352, a middle landing 354 and an upper landing 356. The inner structure 310 includes a drilling assembly 320 located on a lower end thereof, similar to that shown and described above.

As noted above, the inner structure 310 can interact with the outer structure 350, such as through engagement between an inner downhole tool 358 that is part of the inner structure 310 and the landings 352, 354, 356 of the outer structure 350. In some embodiments, the inner downhole tool 358 is a downlinkable running tool that can extend one or more elements to engage with the landings 352, 354, 356, as will be appreciated by those of skill in the art. Although shown and described herein with respect to an engagement between a running tool included in an inner structure and a landing in an outer structure, those of skill in the art will appreciate that any type of downhole operation that is based on position can be carried out and employ embodiments of the present disclosure. For example, the running tool and the landing may be part of the outer and inner structure, respectively. Further, the disclosed apparatus, systems, and methods are the same if applied to a system where a first and second structure are disposed in parallel and not within each other and at least one marker and at least one sensor as well as a landing and a running tool is located in either one of the first and second structure.

As discussed above, knowledge regarding the relative positioning of an inner structure relative to an outer structure is important to be able to carry out certain downhole operations. For example, with reference to FIG. 3, to achieve appropriate engagement between the inner downhole tool 358 and the landings 352, 354, 356 of the outer structure 350, it is important to know the relative positions between the inner structure 310 and the outer structure 350 with high accuracy.

To achieve accurate relative position measurement, one of the inner structure 310 or the outer structure 350 can be configured with one or more markers and the respective outer structure 350 or inner structure 310 can include one or more sensors that are selected to detect the proximity of the markers. For example, the landings 352, 354, 356 can each include one or more markers positioned around or at a known distance to the respective landing 352, 354, 356. The inner structure 310 can include one or more sensors that are located at a known distance to the inner downhole tool 358 of the inner structure 310. For instance, the one or more sensors may be located on and/or proximate to the inner downhole tool 358 of the inner structure 310. The sensors on the inner structure 310 can monitor a signal that is generated by or generated through interaction with the marker of the outer structure 350. The signal can be dependent upon distance between the sensor and the marker.

Figure 4A:
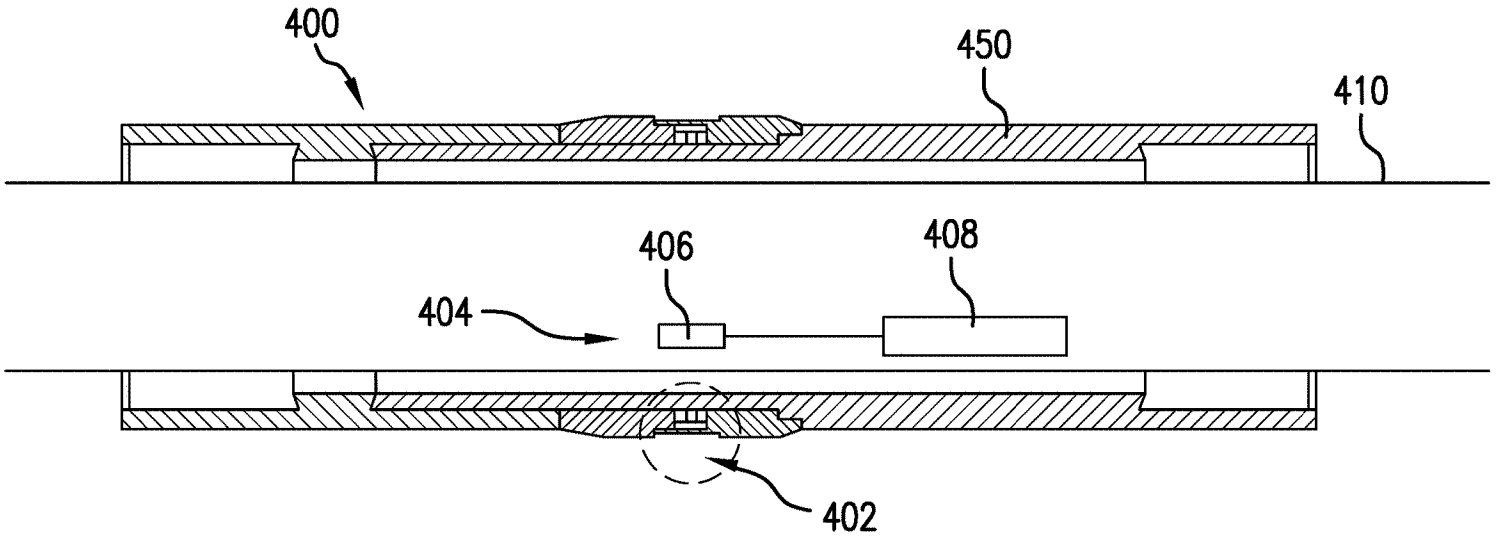
FIG. 4A is a schematic illustration of a portion of a position detection system in accordance with an embodiment of the present disclosure.
Figure 4B:
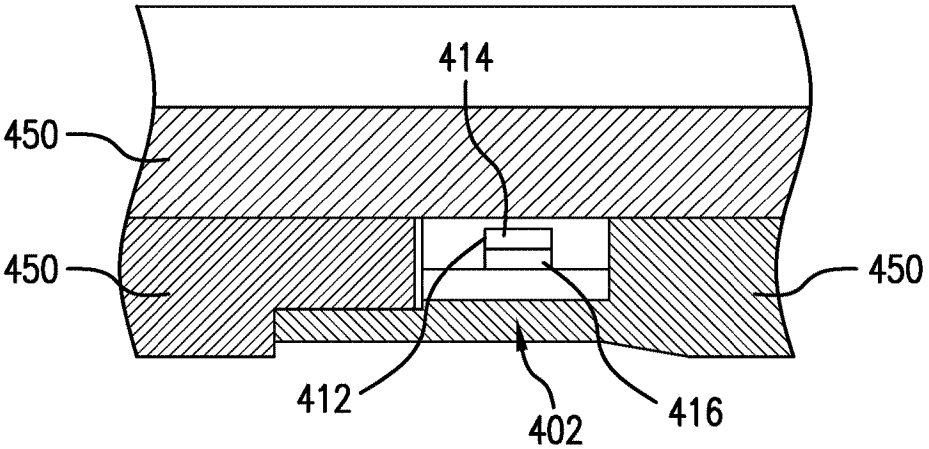
FIG. 4B is a detailed illustration of a marker of the position detection system of FIG. 4A.

Turning now to FIGS. 4A-4B, schematic illustrations of a system 400 having an outer structure 450 with a position marker 402 that is part of a position detection system 404 in accordance with an embodiment of the present disclosure are shown. Further, the system 400 includes an inner structure 410 that can be run within and relative to the outer structure 450.

Although shown and described in FIGS. 4A-4B with various specific components configured in and on the inner structure 410 and the outer structure 450, those of skill in the art will appreciate that alternative configurations with the presently described components located within an outer structure (e.g., a liner) are possible without departing from the scope of the present disclosure. For example, the marker may be located on the inner structure 410 and detected by a sensor in the outer structure 450. The inner structure 410 and/or the outer structure 450 may include one or more components, including, but not limited to, packers, reamers, underreamers, extendable stabilizers, anchors, latching elements, hanger activation tools, liner drive subs, workover tools, milling tools, cutting tools, and/or communication devices, such as couplers, e.g., inductive couplers, capacitive couplers, electromagnetic resonant couplers, or acoustic couplers. In the non-limiting example, such as that shown in FIGS. 4A-4B, the outer structure 450 may include a part of the position detection system 404 (e.g., a marker). The marker may comprise magnetic, optical, acoustic, electromagnetic, mechanical, electromechanical, electric, radio frequency identification (also known as RFID), radioactive, and/or radiation markers. For example, markers of various embodiments of the present disclosure can include a magnet, a radioactive source, an electromagnetic transmitter, an electromagnetic transceiver, a radio-frequency identifier (RFID), a region of high or low conductivity, permittivity, susceptibility, or density, a recess formed in the inner or outer structure (i.e., mechanical features), an optical source, a coil, and/or stator windings. Radio-frequency identifiers, in particular, may comprise a transmitter and/or receiver, an energy store, and electronic device and may be used to read identification of the RFID markers when detecting them or may be arranged to modify a state of the RFID marker (e.g., increase the status of a counter). Markers may comprise a group of individual markers, wherein the group of individual markers may comprise the same kinds of markers or different kinds of markers.

In one non-limiting embodiment, the position marker 402 is a magnetic ring configuration that is installed within a section of the outer structure 450 (shown having various components to house the position marker 402). However, as noted, those of skill in the art will appreciate that the position marker 402 can take any number of configurations without departing from the scope of the present disclosure. For example, magnetic markers, radioactive markers such as gamma markers, capacitive markers, conductive markers, tactile/mechanical components, temperature or heat markers, optical markers, etc. can be used to determine a relative position between the outer structure 450 and the inner structure 410 (e.g., in an axial and/or rotational manner to each other) and thus comprise one or more features of a position marker in accordance with the present disclosure.

Detection of the position marker 402 can be made by a sensor 406 of the position detection system 404 that is part of and/or mounted to the inner structure 410. The sensor 406 is coupled to downhole electronics 408 that are also part of the inner structure 410 (e.g., part of an electronics module on or within the inner structure 410). For example, the sensor 406 can be a magnetic field sensor such as a magnetometer (e.g., a Hall sensor, magnetoresistive sensor, or a fluxgate sensor) that detects the appearance and/or strength of a magnetic field that is generated by the position marker 402. Other sensors that may be employed include, but are not limited to, a sensor for radioactive radiation (e.g., gamma radiation) such as a scintillation crystal (e.g., a NaI scintillation crystal or a counter tube) that detects the appearance and/or strength of radioactive radiation, a sensor for capacity or permittivity that detects the appearance and/or strength of capacity or permittivity, a sensor for resistivity, conductivity, resistance, or conductance such as an electrode (e.g., an electrode arrangement) or a coil (e.g., a coil arrangement) that detects the appearance and/or strength of resistivity, conductivity, resistance, or conductance, a light sensor that detects the appearance and/or strength of light, a tactile or standoff sensor such as a mechanical or acoustic standoff sensor that detects the appearance and/or amount of standoff or distance variations, and a heat or temperature sensor that detects the appearance of heat and/or temperature variations. The downhole electronics 408 can be one or more electronic components that are configured in or on the inner structure 410 and/or a downhole tool of the inner structure 410, and can be part of an electronics module, as will be appreciated by those of skill in the art. In other embodiments, an electronics device (e.g., an electrical wire) can be used instead of the downhole electronics 408.

FIG. 4A is a cross-sectional illustration of a portion of the system 400 including the position marker 402 in the outer structure 450 and the sensor 406 of the inner structure 410 configured to move relative to the position marker 402. FIG. 4B is an enlarged illustration of the position marker 402 as indicated by the dashed circle in FIG. 4A.

In some embodiments, the position detection system 404 can be operably connected to or otherwise in communication with downhole electronics 408 of the inner structure 410 and/or in communication to the surface. Communication from the position detection system 404 can include position information and/or information from which information related to a position can be extracted. For example, a signal strength can be used to determine relative positions of the sensor 406 and the position marker 402 if the signal strength is dependent upon a distance between the sensor 406 and the position marker 402.

Specific downhole operations can be contingent on the specific relative positions of the inner structure 410 relative to the outer structure 450. For example, properly engaging, disengaging, and moving at least parts of the inner structure 410 relative to the outer structure 450 can be achieved by using knowledge of the relative positions of the two parts of the system 400. By knowing the relative position of the inner structure 410 to the outer structure 450, anchor modules, latching elements, packers, measurement tools, testing tools, reamers, such as underreamers, extendable stabilizers, anchors, hanger activation tools, liner drive subs, workover tools, milling tools, cutting tools and/or communication devices, such as couplers, e.g., inductive couplers, capacitive couplers, electromagnetic resonant couplers, or acoustic couplers, etc., can be appropriately engaged and/or operated at desired locations downhole. For example, the position detected by the position detection system 404 can be communicated to the surface to inform about the location of the inner structure 410 relative to an exact position of the position marker 402.

In the non-limiting embodiment shown in FIGS. 4A-4B, the position marker 402 includes a magnetic ring 412 that has opposed north and south poles 414, 416 as shown. In other embodiments, the opposite or differing pole orientation than that shown can be used. Further, in still other alternative embodiments, the position marker 402 can be formed of a different detectable material and/or structure, as noted above. In this embodiment, the magnetic ring 412 is a full 360 degree ring (e.g., wrapped around and in the outer structure 450). In other embodiments, a magnetic ring can be split such that less than 360 degrees is covered by the magnetic ring. Further, in other embodiments, the magnetic ring can have overlapping ends such that the magnetic ring wraps around more than 360 degrees of the outer structure 450. Further still, other configurations can employ spaced magnetic elements, such as buttons, that form the position marker 402.

The magnetic ring 412 of the position marker 402 creates a magnetic field that can be detected by and/or interact with components or features of the inner structure 410 such as the sensor 406. Further, advantageously, ring-shaped position marker 402 as shown in FIGS. 4A-4B (e.g., magnetic ring 412) can be utilized independent of the orientation of the inner structure 410 because, for a ring-shaped marker, the orientation in and relative to the outer structure 450 is irrelevant in detection of a signal. Accordingly, detection of the location of inner structure 410 relative to the outer structure 450 can be easily achieved. Detection can be achieved, in part, by processing the sensor signal, the processing carried out by the downhole electronics 408, and such processing and/or data can be communicated to the surface. Once the detection is communicated to the surface that the position marker 402 is detected, it may be desirable to position the inner structure 410 with precision so that a desired downhole operation can be performed at a precise location.

Figure 5:
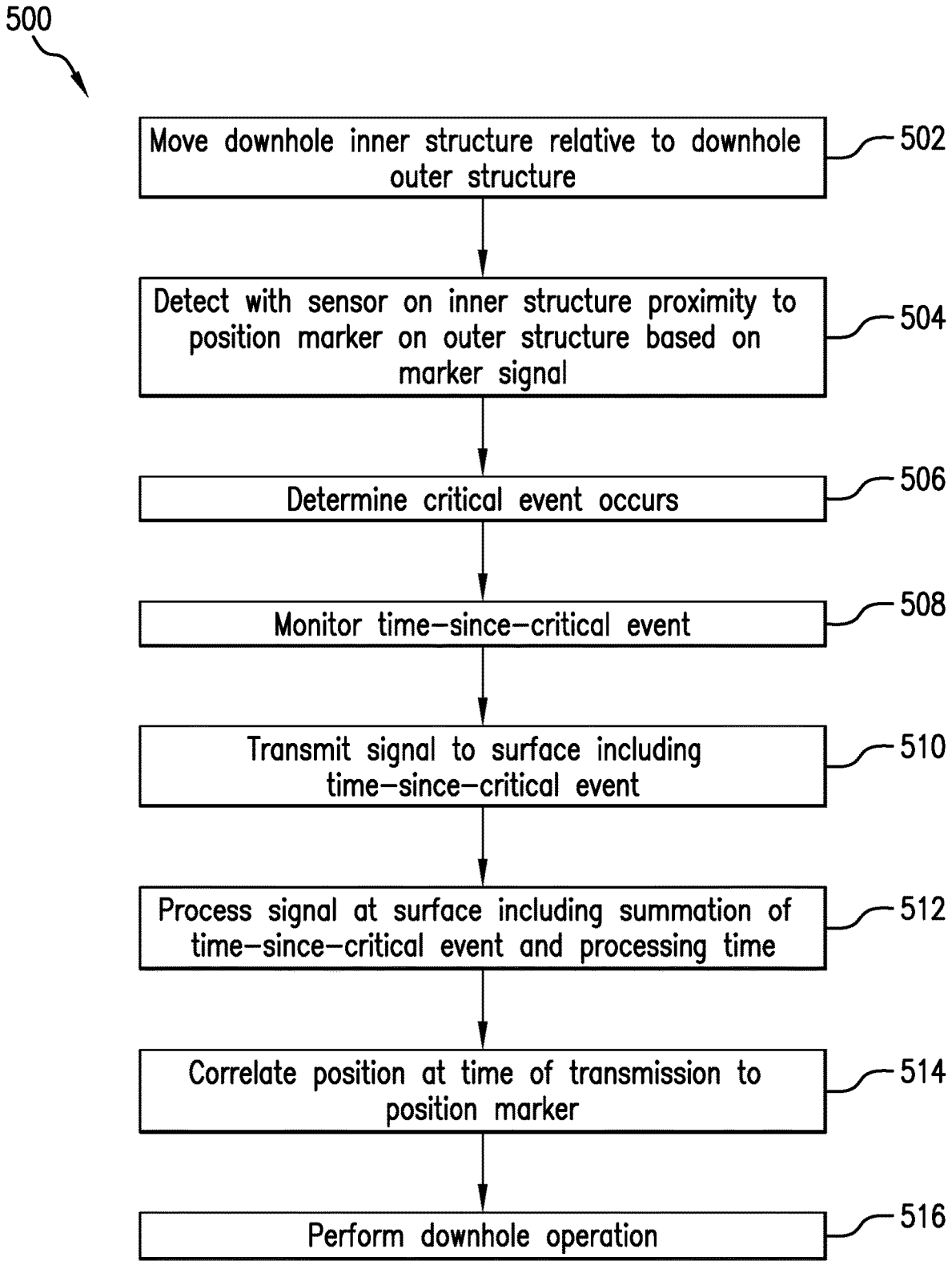
FIG. 5 is a flow process in accordance with an embodiment of the present disclosure.

Turning now to FIG. 5, a flow process 500 for detecting a position of an inner structure relative to an outer structure in accordance with the present disclosure is shown. The flow process 500 can be performed by downhole systems as shown and described herein. Particularly, the flow process 500 is performed at least partially downhole with a first structure having at least one position marker and a second structure that is moveable along and relative to the first structure or vice versa. For example, the flow process 500 may be performed downhole with an outer structure having at least one position marker and an inner structure that is moveable within and relative to the outer structure or vice versa. For example, in some embodiments, the outer structure can be a liner or outer string and the inner structure can be an inner string. Further, in other embodiments, the inner structure can be a wireline tool that is conveyed within an outer structure such as a liner or casing. Various other configurations are possible without departing from the scope of the present disclosure.

At block 502, the inner structure is moved downhole relative to an outer structure. The inner structure includes at least a sensor and the outer structure includes the position marker that is detectable by the sensor of the inner structure. The position marker is located along the outer structure to enable knowledge of when the inner structure is near and/or passes the position marker during relative movement of the inner structure and the outer structure. In an alternative embodiment, the inner structure includes a marker and the outer structure includes the sensor. In one embodiment, e.g., when the inner structure includes the marker and the outer structure includes the sensor, the communication path to the surface may include at least a part that utilizes wireless communication.

At block 504, the sensor detects the position marker. The detection can be a strength of a detected signal, property, characteristic, etc., that is based on the sensor-position marker configurations. For example, when using a magnetic sensor/marker configuration, magnetic field strength or magnetic flux density can be the detected property. When using a radiation based sensor/marker, the detected property can be a count or count-per-second (i.e., activity). Various other detected properties can be employed based on the specific sensor/marker configuration, including, but not limited to, induced currents, voltages, optical patterns, optical strength, acoustic signals, electromagnetic signals, geometric features, and/or radiation. etc.

The sensor is connected to electronics that can record the detected property of the marker, and thus a detection-versus-time can be achieved. The combination of the sensor and electronics (whether separate or integral with the sensor) can be configured to monitor for a critical event such as a critical value of the detected property. Processing may be involved, such as the application of calibrations, corrections, calculation of averages, standard deviations, or other statistical functions. In various configurations the critical event can be a peak value or peak strength of the detected property (e.g., strongest magnetic field, highest count-per-second, etc.). However, in other configurations, the detected critical event can be a change in polarity (such as a magnetic z-field sensor would sense when passing one or more magnets, such as dipole magnets, with the dipole axis pointing perpendicular to the trajectory of the passing magnetic z-field sensor), a crossing of a positive to a negative value (e.g., change in voltage sign). Further, in some embodiments the critical event can be a feature of a detected curve, e.g., characterized by a specific value the first, second, etc. derivative of the detected curve or alignment of one or more curves generated by interaction of the sensor with the marker. Still further, a critical event can be defined a predetermined time after one or more features that may be understood as critical events as discussed above.

At block 506, the sensor/electronics determine that the critical event has been detected. If the critical event is a peak in the sensor response, detecting of the critical event can be based on an increasing signal strength and then a decreasing signal strength, and the system determines that the critical event occurred at a time just before the signal strength decreased. In some embodiments, the critical event can be a known event (e.g., a change in polarity or voltage) and/or a specific known or predetermined value, and thus the critical event can be detected. In some embodiments, the time of the critical event can be calculated based on the time of detection or other times that are related to the detected signal. For instance, the time of the critical event could be the average of the time when the signal was first detected and the time when the signal level falls below noise level(s). Further, in some embodiment, the critical event can be an expected value or range of values that is based on testing and accounting for real-world variability and/or error. Thus, the critical event is not limited to a single test and/or detection process or algorithm.

At block 508, with the critical event detected, the system will count or determine or monitor a time-since-critical event which is the time since the critical event occurred or since the critical event was detected. The counting can be based on a timestamp of the detection or occurrence of the critical event or a timestamp that is related to the detection or occurrence of the critical event, e.g., a predetermined time period before or after the critical event was detected. In some embodiments, a clock or timer can start once the critical event had occurred or is detected or start a known time period after the critical event has occurred or was detected. In either event, a time since the critical event is detected or has occurred can be obtained.

At block 510, a signal is transmitted to the surface from the inner structure regarding position, e.g., regarding position of the inner structure relative to the outer structure. The signal includes the time-since-critical event. The end of the time period of the time-since-critical event may be the event of transmission of the signal or a time that is related to the event of transmission of the signal, e.g., a time that includes additional time periods such as processing times, transmission times, or a predefined time interval before or after the transmission of the signal occurs. Accordingly, the time-since-critical event represents a time period which is related to the time when the marker is passed by the sensor or vice versa. Accordingly, any subsequent travel of the inner structure relative to the outer structure can be determined.

At block 512, the transmitted signal is received at the surface and processed to determine a position of the inner structure. Specifically, the processing includes a summation of the time-since-critical event and a processing time, which may be a known time or a calculated time and may be part of the system as a whole. The processing time may include the transmission time, i.e., the time from transmitting from the inner structure until the signal reaches a receiver at the surface. The transmission time often depends on operational parameters, such as depth and/or type of fluid, and may be determined by taking the operational parameters into account. For example, the transmission time typically increases with increasing depth of the borehole and is usually higher for water-based mud than for oil-based mud. The transmission time may be calculated based on operation parameters or may be taken from a look-up table. The look-up table may be a conventional look-up table, typically printed on paper, or a look-up table that is electronically accessible, such as by a processing system executing software instructions to determine the transmission time. The determination of the transmission time may be based on lab measurements and/or theoretical considerations. The transmission time may also be measured exemplarily for a drilling run or for each transmission, individually.

Further, the processing time may include any processing time that occurs on surface or downhole, such as processing in the electronics for preparing the transmitted signal (e.g., applying compensation, correction, or calibration algorithms to measurements, encoding or decoding information, repeating or amplifying signals, applying data compression schemes and/or telemetry correction techniques known in the art, converting analog signals to digital signals or vice versa, such as converting electronic analog signals to digital electronic signals or vice versa or converting electronics digital information into a mud pulse or vice versa for mud pulse telemetry). The processing performed at block 512 can include determination of a total time delay that includes both the time-since-critical event and any known system time delay including, but not limited to, the processing time that may include transmission time and other calculated, predetermined, or otherwise known time intervals.

At block 514, the processed signal allows for a correlation of relative position between the inner structure and the outer structure, which accounts for any relative movement since the time of the critical event. By determining the depth-related data, such as the block height or the depth that was acquired by the surface depth tracking system at the time of the critical event, the relative position of the outer and inner structure may be identified at any later time, such as the time of the critical event plus the total time delay. As such, the precise position of the inner structure relative to the outer structure can be known.

Alternatively, instead of transmitting the time-since-critical event, the measured time of the critical event can be transmitted to the surface, e.g., as a time stamp. However, transmitting a time stamp typically may require more data bits as compared to transmitting a time-since-critical event, because the expected value range for a time stamp divided by the required numeric resolution is much higher for the time stamp than that for the time-since-critical event. For instance, if the expected value range for the time stamp is two weeks and the required numeric resolution is one minute, the time stamp would be digitized in at least two weeks/one minute, which equals 20,160 levels which would require 15 bits. In contrast, if the expected value range for the time-since-critical event is ten minutes and the required numeric resolution is one minute, the time-since-critical event can be digitized in no more than ten levels corresponding to four bits. In addition, transmitting the time stamp would rely upon the accuracy of the downhole clock being comparable with the accuracy of the surface clock. Downhole clocks, however, are subject to harsh environments in which they are used, including enhanced temperatures and high temperature variations, and may be subject to inaccuracies such as drifts, etc. The amount of such inaccuracies typically increases with time, and thus it is beneficial to transmit only the relatively short time-since-critical event instead of the time stamp. The problem of drifting downhole clocks, however, can be mitigated by repeated synchronization with a more accurate clock on surface or downhole.

At block 516, a downhole operation is performed based on the correlated position. Such downhole operation can include adjusting the physical position of the inner structure relative to the outer structure. For example, the time-since-critical event, the processing time, and/or the total time delay can be indicative of an "overshoot" or additional relative travel between the inner and outer structures. By determining the depth-related data, such as the block height or the depth that was acquired by a surface depth tracking system at the time when the critical event has occurred or was detected by the downhole sensor, a reverse operation can be used to move the inner structure to a specific location where the critical event has occurred or was detected. Alternatively, the inner structure may be moved to a specific location at a distance, e.g., a predefined distance, from the location where the critical event has occurred or was detected.

At the specific location, a downhole operation may be performed which can be, in combination or alternatively, an actuation or action. Such actuation or action can include extension of anchors, latching elements, stabilizers, or blades such as reamer or underreamer blades, activation of packers, hanger activation tools, liner drive subs, workover tools, milling tools, cutting tools and/or communication devices, such as couplers, e.g., inductive couplers, capacitive couplers, electromagnetic resonant couplers, or acoustic couplers, testing or sampling (e.g., fluid testing or coring) a formation, retraction of blades, such as reamer or underreamer blades, and/or other actions where it may be advantageous to be performed at a very specific location. For example, positioning the inner structure relative to the outer structure such that engagement with a landing of the outer structure can be achieved (e.g., as shown and described with respect to FIGS. 2-3).

In some configurations, the time of the critical event can be stored in memory until it can be sent to the surface. In this case, the transmission time can be determined with high accuracy, which leads to an overall improvement of the total time delay determination. For example, in some embodiments, loss of mud-flow can result in a loss of power and/or a time delay in transmission. Further, in some embodiments, the transmission media itself may not be present, such as a lack of mud that is capable of mud pulse telemetry during a tripping event. Then, when the signal is finally sent to the surface, one or more critical events can be allocated in time, corresponding locations can be determined and appropriate action can be taken. The information, once at the surface, can be visualized based on user needs.

Thus, in accordance with embodiments of the present disclosure, time-since-critical event measurement can be used to accurately determine a delay from an event and thus a precise absolute and/or relative position of downhole elements can be obtained. Advantageously, the transmission is merely a time delay, and thus with recording and transmitting the time delay instead of an absolute time stamp of the peak detection, no clock synchronization is required. This is particularly advantageous because a downhole time can differs from uphole time, e.g., due to temperature differences between the two locations, with time difference typically increasing over time.

Although shown and described above with respect to a single sensor on the inner structure, those of skill in the art will appreciate that the present disclosure is not so limited. For example, multiple sensors (on the inner or outer structure) and/or markers (on the outer or inner structure, respectively) can be used for downhole operations. For example, multiple markers could follow a particular, predetermined pattern at a "marker position," e.g., two markers in close proximity at a first marker position and three markers in close proximity at a second marker position. Such marker positions, with multiple markers, can enable marker coding. In this fashion, different positions along the length of the outer structure can be identified.

As noted above, embodiments of the present disclosure can be included in steerable drilling liners (e.g., as shown in FIGS. 2-3) with an inner string and an outer string. Alternative configurations can be employed for monitoring, adjusting and/or aligning a position of tools comprising anchors, latching elements, stabilizers, or blades such as reamer or underreamer blades, such as, but not limited to, packers, hanger activation tools, liner drive subs, workover tools, milling tools, cutting tools, wireline tools, and/or communication devices, such as couplers, e.g., inductive couplers, capacitive couplers, electromagnetic resonant couplers, or acoustic couplers, testing or sampling (e.g., fluid testing or coring) tools, retraction of blades, such as reamer or underreamer blades, or other tools or devices that are disposed within or along a casing or liner or any other type of tubular equipment that has markers or marker sensing sensors disposed along such tubular and/or other actions where it may be advantageous to be performed at a very specific location.

Advantageously, the total time delay (including the time-since-critical event and the processing time) can be used to accurately adjust a position of various downhole components to be used for specific downhole operations at specific locations. As such, very accurate placement of downhole tools (e.g., parts of the inner structure) can be achieved.

In some embodiments, several markers can be detected by a single sensing element before the time-since-critical event data is transmitted to surface. That is, the time-since-critical event data can include multiple time-since-critical event calculations. This may happen if no telemetry is available, such as during tripping events. The sensor of the inner structure would detect the different markers of the outer structure when passing the markers and will record the time since the condition of the sensor signal was met for at least one of the different markers. Once telemetry is available again, the different time delays (e.g., different time-since-critical events) or time stamps belonging to the detection of the different markers are transmitted uphole to the surface.

Advantageously, embodiments provided herein provide methods and systems to determine a precise position of downhole elements relative to each other. Further, methods and systems for initiating downhole operations in a borehole are provided. In accordance with embodiment of the present disclosure, a first structure, such as an inner structure (e.g., an inner tool, inner string, wireline tool, etc.) is disposed along (e.g., within) a second structure, such as an outer structure (e.g., borehole, casing, outer string, liner, etc.). The first structure is equipped with one or more sensors and the second structure is equipped with one or more markers or vice versa. The locations of the sensors and/or the markers can be predetermined and set to signify specific locations of one or both of the first and second structures.

A sensor system is used to monitor for a signal that is generated by the marker and/or interaction with the marker (depending on the sensor/marker configuration). The sensor system will monitor for a critical event or event that is related to the signal that the sensor is detecting. The sensor system will then record a time-since-critical event.

The sensor system or downhole electronics will transmit with a transmitter data from downhole to the surface indicating the time-since-critical event. A processor (at the surface or downhole) will determine a total time delay based on the time-since-critical event and any known processing times, transmission times, waiting times, and/or other time delays.

Once the total time delay is obtained, precise information regarding relative position of the first structure and the second structure can be determined. Based on this, instructions can be sent from the surface to initiate a downhole operation. The downhole operation can include adjusting the relative positions of the first and second structures based on the calculated relative positions and/or performing a specific operation knowing the precise locations of the first and second structures.

Those of skill in the art will appreciate that depth is not specifically part of the relative positions of the inner and outer structures. At the surface, a known time delay is either received, calculated, measured, or otherwise determined, or is known (e.g., in case of a predetermined constant time delay, e.g. with a constant logging speed) and combined with the processing time, transmission time, and/or the time-since-critical event. The time delay can be used to locate the position of the marker relative to the sensor (reverse of the above described operation) and a specific operation can be performed. That is, it is not necessary to record anywhere the depth where the marker is, but rather only the relative positions, based on the measured or calculated time-since-critical event is needed. However, in an alternative embodiment, the relative position in combination with the depth tracking may be used to calculate and/or display an absolute position.

In accordance with embodiments of the present disclosure, it is even possible to leave out any time-depth correlation and determine the location of the marker position (or sensor position) only via a time-reversed movement of the inner structure. In this manner, a wrong time-depth correlation or failure in a tally sheet could be identified or overcome.

Advantageously, embodiments provided herein enable measuring the position of one structure relative to another structure, and thus a position for downhole operations can be precisely measured. For example, in one non-limiting example employing embodiments disclosed herein, a measurement of a position for latch-in contact can be precisely identified and/or measured. The latch-in can be between a running tool with extendable elements and a landing of an outer liner, casing, or string. Such position measurement can be verified using embodiments of the present disclosure (e.g., multiple sensors relative to multiple markers at different locations), corrections can be made for imprecise tally, pipe stretch, and/or other unforeseen failures and/or events (e.g., liner movement).

Further, advantageously, embodiments provided herein enable precise relative position measurement that is completely independent of the transmission technology or method of communication. Accordingly, any time an opportunity is provided to send the time-since-critical event information, such information can be sent, regardless of the communication type. As such, there is no extra time needed to find a specific position, e.g., in the event of tripping, embodiments described herein can be employed, and so no subsequent position measurement is needed after tripping is complete. Further, the information can be sent whenever a communication channel is available.

Moreover, as noted above, marker coding is possible wherein different positions indicated by markers can be coded such that a relative position between an inner structure and an outer structure can be obtained accurately. Furthermore, multiple different positions can be measured and/or detected independently from each other using multiple markers at different locations along an outer structure.

Further, advantageously, embodiment provided herein allow for correction for transmission time and latency. Thus, precise position measurements can be obtained even with very slow communication channels, such as mud pulse telemetry. Moreover, no special equipment is required for transmission of the obtained time-since-critical event data. For example, utilization of wired pipe is possible but not required, and yet very precise position information can be obtained.

Moreover, because the detection of the marker by the sensor is based on a critical event (or value), high relative speeds between the inner and outer structures used during for example, tripping events, do not impact the reliability of embodiments of the present disclosure. Further, the amount of material used to form the marker in the outer structure can be reduced as compared to prior position measurement techniques. That is, only a specific critical event is required to be detected and not the actual position of the inner structure (which might require a large marker).

Embodiment 1: A method to initiate a downhole operation in a borehole formed in the earth, the method comprising: deploying a first structure at least partially in the borehole; moving a second structure at least partially along the first structure, wherein at least one of the first structure and the second structure is equipped with a sensor and the other of the first and second structure is equipped with a marker detectable by the sensor; detecting a critical event that is related to an interaction of the sensor and the marker; measuring a time-since-critical event; determining a time delay based on the time-since-critical event; transmitting, with a telemetry system, data from the earth's subsurface to the earth's surface indicating that the critical event has been detected; and initiating a downhole operation by using the determined time delay.

Embodiment 2: The method of any embodiment herein, wherein the first structure is an inner structure and the second structure is an outer structure, wherein the inner structure is at least partially within the outer structure.

Embodiment 3: The method of any embodiment herein, wherein the outer structure is a liner and the marker is located within the liner.

Embodiment 4: The method of any embodiment herein, wherein the transmitted data includes a time information based on the time-since-critical event.

Embodiment 5: The method of any embodiment herein, wherein the time delay is determined by combining the time-since-critical event with at least one of a processing time, a transmission time, and a system time delay.

Embodiment 6: The method of any embodiment herein, wherein one of the first structure and the second structure includes an expandable downhole component and the downhole operation comprises expanding the expandable downhole component.

Embodiment 7: The method of any embodiment herein, wherein the downhole operation comprises activation or deactivation of at least one of a packer, a reamer, an underreamer, an extendable stabilizer, an anchor, a latching element, a hanger activation tool, a cutting tool, a milling tool, a liner drive sub, a workover tool, a measurement tool, a timer, or a communication device.

Embodiment 8: The method of any embodiment herein, wherein the marker is a magnet, a radioactive source, an electromagnetic transmitter, an electromagnetic transceiver, a radio-frequency identifier, a region of high or low conductivity, permittivity, susceptibility, or density, a recess in at least one of the first structure and the second structure, an optical source, a coil, a group of individual markers comprising the same kind of markers, or a group of individual markers comprising different kinds of markers.

Embodiment 9: The method of any embodiment herein, wherein the downhole operation is initiated using a time-depth correlation.

Embodiment 10: The method of any embodiment herein, wherein the critical event is related to at least one of a signal strength, a change of sign or polarity of a signal response, a first or higher order derivative of a signal response, and a curve alignment detected by the sensor.

Embodiment 11: The method of any embodiment herein, wherein the telemetry system is deactivated at a time when the critical event is detected.

Embodiment 12: The method of any embodiment herein, wherein the at least one of the first structure and the second structure is equipped with two or more markers.

Embodiment 13: The method of any embodiment herein, wherein detecting the critical event includes distinguishing interactions of the sensor and the two or more markers based on a signal response of each of the two or more markers.

Embodiment 14: A system to initiate a downhole operation, the system comprising: a first structure at least partially disposed in the earth's subsurface; a second structure movable along the first structure; a sensor on at least one of the first structure and the second structure; a marker on at least one of the first structure and the second structure, the marker detectable by the sensor; a transmitter on one of the first structure and the second structure, the transmitter configured to transmit data from the earth's subsurface to the earth's surface, wherein the system is configured to: detect a critical event that is related to an interaction of the sensor and the marker; measure a time-since-critical event to establish a time delay based on the time-since-critical event; transmit data from the earth's subsurface to the earth's surface indicating that the critical event has been detected; and initiate the downhole operation by using the established time delay.

Embodiment 15: The system of any embodiment herein, further comprising a control unit located on the surface, the control unit configured to receive the transmitted data, the control unit further configured to determine relative positions between the inner structure and the outer structure based on the time delay.

Embodiment 16: The system of any embodiment herein, wherein the first structure is an inner structure and the second structure is an outer structure, wherein the inner structure is at least partially within the outer structure.

Embodiment 17: The system of any embodiment herein, wherein the inner structure is a downhole inner-string that includes a downhole component and the downhole operation comprises expanding the downhole component.

Embodiment 18: The system of any embodiment herein, wherein the inner structure includes at least one of a packer, a reamer, an underreamer, an extendable stabilizer, an anchor, a latching element, a hanger activation tool, a liner drive sub, a cutting tool, a milling tool, a workover tool, and a communication device.

Embodiment 19: The system of any embodiment herein, wherein the marker is at least one of a magnet, a radioactive source, an electromagnetic transmitter, an electromagnetic transceiver, a radio-frequency identifier, a region of high or low conductivity, permittivity, susceptibility, or density, a recess in at least one of the first and second structure, an optical source, a coil, and a group of individual markers.

Embodiment 20: The system of any embodiment herein, further comprising a plurality of markers, wherein at least two markers are located at different locations along a length of at least one of the first structure and the second structure.

In support of the teachings herein, various analysis components may be used including a digital and/or an analog system. For example, controllers, computer processing systems, and/or geo-steering systems as provided herein and/or used with embodiments described herein may include digital and/or analog systems. The systems may have components such as processors, storage media, memory, inputs, outputs, communications links (e.g., wired, wireless, optical, or other), user interfaces, software programs, signal processors (e.g., digital or analog) and other such components (e.g., such as resistors, capacitors, inductors, and others) to provide for operation and analyses of the apparatus and methods disclosed herein in any of several manners well-appreciated in the art. It is considered that these teachings may be, but need not be, implemented in conjunction with a set of computer executable instructions stored on a non-transitory computer readable medium, including memory (e.g., ROMs, RAMs), optical (e.g., CD-ROMs), or magnetic (e.g., disks, hard drives), or any other type that when executed causes a computer to implement the methods and/or processes described herein. These instructions may provide for equipment operation, control, data collection, analysis and other functions deemed relevant by a system designer, owner, user, or other such personnel, in addition to the functions described in this disclosure. Processed data, such as a result of an implemented method, may be transmitted as a signal via a processor output interface to a signal receiving device. The signal receiving device may be a display monitor or printer for presenting the result to a user. Alternatively or in addition, the signal receiving device may be memory or a storage medium. It will be appreciated that storing the result in memory or the storage medium may transform the memory or storage medium into a new state (i.e., containing the result) from a prior state (i.e., not containing the result). Further, in some embodiments, an alert signal may be transmitted from the processor to a user interface if the result exceeds a threshold value.

Furthermore, various other components may be included and called upon for providing for aspects of the teachings herein. For example, a sensor, transmitter, receiver, transceiver, antenna, controller, optical unit, electrical unit, and/or electromechanical unit may be included in support of the various aspects discussed herein or in support of other functions beyond this disclosure.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The flow diagram(s) depicted herein is just an example. There may be many variations to this diagram or the steps (or operations) described therein without departing from the scope of the present disclosure. For instance, the steps may be performed in a differing order, or steps may be added, deleted or modified. All of these variations are considered a part of the present disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the present disclosure.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While embodiments described herein have been described with reference to various embodiments, it will be understood that various changes may be made and equivalents may be substituted for elements thereof without departing from the scope of the present disclosure. In addition, many modifications will be appreciated to adapt a particular instrument, situation, or material to the teachings of the present disclosure without departing from the scope thereof. Therefore, it is intended that the disclosure not be limited to the particular embodiments disclosed as the best mode contemplated for carrying the described features, but that the present disclosure will include all embodiments falling within the scope of the appended claims.

Accordingly, embodiments of the present disclosure are not to be seen as limited by the foregoing description, but are only limited by the scope of the appended claims.

What is claimed is:

1. A method to initiate a downhole operation in a borehole formed in the earth, the method comprising:

deploying a first structure at least partially in the borehole;

moving a second structure at least partially along the first structure, wherein at least one of the first structure and the second structure is equipped with a sensor and the other of the first and second structure is equipped with a marker detectable by the sensor;

detecting a critical event that is related to an interaction of the sensor and the marker;

measuring a time-since-critical event;

determining a time delay based on the time-since-critical event;

transmitting, with a telemetry system, data from the earth's subsurface to the earth's surface indicating that the critical event has been detected; and sending an instruction from the earth's surface to initiate the downhole operation by using the determined time delay.

2. The method of claim 1, wherein the first structure is an inner structure and the second structure is an outer structure, wherein the inner structure is at least partially within the outer structure.

3. The method of claim 2, wherein the outer structure is a liner and the downhole operation is a liner operation.

4. The method of claim 1, wherein the transmitted data includes a time information based on the time-since-critical event.

5. The method of claim 1, wherein the time delay is determined by combining the time-since-critical event with at least one of a processing time, a transmission time, and a system time delay.

6. The method of claim 1, wherein at least one of the first structure and the second structure includes an expandable downhole component and the downhole operation comprises expanding the expandable downhole component.

7. The method of claim 1, wherein the downhole operation comprises activation or deactivation of at least one of a packer, a reamer, an underreamer, an extendable stabilizer, an anchor, a latching element, a hanger activation tool, a cutting tool, a milling tool, a liner drive sub, a workover tool, a measurement tool, a timer, or a communication device.

8. The method of claim 1, wherein the marker is a magnet, a radioactive source, an electromagnetic transmitter, an electromagnetic transceiver, a radio-frequency identifier, a region of high or low conductivity, permittivity, susceptibility, or density, a recess in at least one of the first structure and the second structure, an optical source, a coil, a group of individual markers comprising the same kind of markers, or a group of individual markers comprising different kinds of markers.

9. The method of claim 8, wherein the at least one of the first structure and the second structure is equipped with two or more markers.

10. The method of claim 9, wherein detecting the critical event includes distinguishing interactions of the sensor and the two or more markers based on a signal response of each of the two or more markers.

11. The method of claim 1, wherein the downhole operation is initiated using a time-depth correlation.

12. The method of claim 1, wherein the critical event is related to signal strength, change of sign or polarity of a signal response, first or higher order derivative of a signal response, or curve alignment detected by the sensor.

13. The method of claim 1, wherein the telemetry system is deactivated at a time when the critical event is detected.

14. A system to initiate a downhole operation, the system comprising:

a first structure at least partially disposed in the earth's subsurface;

a second structure movable along the first structure;

a sensor on at least one of the first structure and the second structure;

a marker on at least one of the first structure and the second structure, the marker detectable by the sensor;

a transmitter on one of the first structure and the second structure, the transmitter configured to transmit data from the earth's subsurface to the earth's surface, wherein the system is configured to:

detect a critical event that is related to an interaction of the sensor and the marker;

measure a time-since-critical event to establish a time delay based on the time-since-critical event;

transmit the data from the earth's subsurface to the earth's surface indicating that the critical event has been detected; and send an instruction from the earth's surface to initiate the downhole operation by using the established time delay.

15. The system of claim 14, further comprising a control unit located on the surface, the control unit configured to receive the transmitted data, the control unit further configured to determine relative positions between the first structure and the second structure based on the time delay.

16. The system of claim 14, wherein the first structure is an inner structure and the second structure is an outer structure, wherein the inner structure is at least partially within the outer structure.

17. The system of claim 16, wherein the inner structure is a downhole inner-string that includes a downhole component and the downhole operation comprises expanding the downhole component.

18. The system of claim 16, wherein the inner structure includes one or more elements selected from packers, reamers, underreamers, extendable stabilizers, anchors, latching elements, hanger activation tools, liner drive subs, cutting tools, milling tools, workover tools, and communication devices.

19. The system of claim 14, wherein the marker is a magnet, a radioactive source, an electromagnetic transmitter, an electromagnetic transceiver, a radio-frequency identifier, a region of high or low conductivity, permittivity, susceptibility, or density, a recess in at least one of the first and second structure, an optical source, a coil, or a group of individual markers.

20. The system of claim 14, further comprising a plurality of markers, wherein at least two markers are located at different locations along a length of at least one of the first structure and the second structure.

* * * * *